US010454195B2

(12) United States Patent
Saeki

(10) Patent No.: US 10,454,195 B2
(45) Date of Patent: Oct. 22, 2019

(54) ELECTRICAL CONNECTOR

(71) Applicant: HIROSE ELECTRIC CO., LTD., Tokyo (JP)

(72) Inventor: Masaaki Saeki, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/175,402

(22) Filed: Oct. 30, 2018

(65) Prior Publication Data

US 2019/0148867 A1 May 16, 2019

(30) Foreign Application Priority Data

Nov. 10, 2017 (JP) ..... 2017-217299

(51) Int. Cl.

| | |
|---|---|
| ***H01R 13/15*** | (2006.01) |
| ***H01R 24/40*** | (2011.01) |
| ***H01R 13/502*** | (2006.01) |
| ***H01R 13/187*** | (2006.01) |
| ***H01R 9/05*** | (2006.01) |
| *H01R 13/625* | (2006.01) |
| *H01R 13/52* | (2006.01) |
| *H01R 103/00* | (2006.01) |
| *H01R 13/213* | (2006.01) |

(52) U.S. Cl.

CPC ..... *H01R 13/15* (2013.01); *H01R 9/0524* (2013.01); *H01R 13/187* (2013.01); *H01R 13/502* (2013.01); *H01R 24/40* (2013.01); *H01R 13/213* (2013.01); *H01R 13/521* (2013.01); *H01R 13/625* (2013.01); *H01R 2103/00* (2013.01)

(58) Field of Classification Search

CPC .... H01R 13/15; H01R 9/0524; H01R 13/187; H01R 13/502

USPC ..... 439/474

See application file for complete search history.

(56) References Cited

U.S. PATENT DOCUMENTS 5,131,862 A * 7/1992 Gershfeld ..... H01R 13/625 439/357

5,145,412 A * 9/1992 Tan ..... H01R 13/7195 333/185

(Continued)

FOREIGN PATENT DOCUMENTS

JP 2001052821 A 2/2001

*Primary Examiner* — Alexander Gilman

(74) *Attorney, Agent, or Firm* — Rankin, Hill & Clark LLP

(57) ABSTRACT

Provided is a technology for improving high-frequency characteristics in an electrical connector such as a BNC coaxial connector. An electrical connector according to the present disclosure includes: a cylindrical outer conductor; a center terminal located on a central axis of the outer conductor along an axial direction of the central axis; an insulator located coaxially between the outer conductor and the center terminal; and a band-shaped C-ring located inside the outer conductor. The outer conductor includes a housing groove for housing the C-ring, the housing groove being formed on an inner peripheral surface of the outer conductor on a front end side of the center terminal, and the housing groove includes a slope of which inner diameter is smaller on a front end side than on a rear end side, the slope being formed on a front end portion of the housing groove. An end surface on a front end side of the C-ring is corrugated.

13 Claims, 5 Drawing Sheets

(56) References Cited

U.S. PATENT DOCUMENTS

| | | | | |
|---|---|---|---|---|
| 5,938,465 | A * | 8/1999 | Fox, Sr. | H01R 13/627 439/350 |
| 6,746,268 | B2 * | 6/2004 | Laub | H01R 9/053 439/394 |
| 6,746,277 | B2 * | 6/2004 | Laub | H01R 9/0503 439/578 |
| 7,126,064 | B1 * | 10/2006 | Shemtov | H01R 13/5812 174/662 |
| 8,047,872 | B2 * | 11/2011 | Burris | H01R 13/502 439/271 |
| 9,166,348 | B2 * | 10/2015 | Burris | H01R 13/5205 |
| 9,287,659 | B2 * | 3/2016 | Burris | H01R 9/0524 |
| 9,444,156 | B2 * | 9/2016 | Chastain | H01R 4/646 |
| 9,633,765 | B2 * | 4/2017 | Natoli | H01R 4/029 |
| 10,211,547 | B2 * | 2/2019 | Burris | H01R 9/0524 |
| 2005/0272312 | A1 * | 12/2005 | Hashiguchi | H01R 9/0524 439/578 |
| 2006/0166552 | A1 * | 7/2006 | Bence | H01R 9/05 439/578 |
| 2008/0003861 | A1 * | 1/2008 | Kauffman | H01R 13/6277 439/345 |
| 2010/0062641 | A1 * | 3/2010 | Maruyama | H01R 13/6277 439/582 |
| 2012/0225575 | A1 * | 9/2012 | Tagawa | H01R 12/7023 439/345 |
| 2015/0044912 | A1 * | 2/2015 | Hashimoto | H01R 9/0518 439/626 |

* cited by examiner

ELECTRICAL CONNECTOR

CROSS-REFERENCE TO RELATED APPLICATION

This application claims priority from Japanese Patent Application No. 2017-217299 filed with the Japanese Patent Office on Nov. 10, 2017, the entire content of which is hereby incorporated by reference.

BACKGROUND

1. Technical Field

An embodiment of the present disclosure relates to an electrical connector, and particularly relates to a BNC (Bayonet Neill Concelman) coaxial connector that is suitable to transmit a high-frequency signal.

2. Description of the Related Art

BNC coaxial connectors are conventionally known as electrical connectors that connect coaxial cables. The BNC coaxial connectors are relatively good in frequency characteristics, or in other words, have relatively constant characteristics such as attenuation characteristics from low frequency to high frequency, and can be configured in small size. Hence, the BNC coaxial connectors are widely used for, for example, measurement, communications, video signals, and medical equipment. A mechanism that can easily lock the fit between connectors in one operation without using screws (a bayonet type) is employed. Hence, the connector can be easily engaged and disengaged. As a result, BNC coaxial connectors pursuant to JIS standards (Japanese Industrial standards) are widely used.

Examples of a technology related to such coaxial connectors include a technology described in Patent Document 1 (JP-A-2001-52821).

In recent years, BNC coaxial connectors that have excellent frequency characteristics and are suitable to transmit high-frequency signals have been required with increasing speed and capacity of transmission signals. In these BNC connectors, a spring may be used as a contact structure of an outer conductor to improve the frequency characteristics. In such a known contact structure, the contact becomes unstable, for example, when prying or vibrations occur, furthermore, when they occur at the same time. As a result, characteristics may not be stable at high frequencies, especially in a frequency band at 4 GHz or more. Moreover, when vibrations occur, the contact between connectors may be momentarily disengaged, at least electrically.

Moreover, the coaxial connector disclosed in JP-A-2001-52821 described above has a plurality of axial split grooves 11*d* on an outer conductor. An outer conductor of a coaxial connector such as a BNC is generally formed into a spring shape by forming such grooves. However, general materials such as brass have great elasticity. Therefore, it is deformed relatively easily by, for example, the prying of a connector to be fitted. As a result, the contact between the connectors may become unstable.

Hence, an object of an electrical connector according to the present disclosure is to provide a technology for stabilizing the contact of a contact portion of an outer conductor even when vibrations, prying, and the like occur, and improving high-frequency characteristics in an electrical connector such as a BNC coaxial connector.

SUMMARY

An electrical connector according to the present disclosure includes: a cylindrical outer conductor; a center terminal located on a central axis of the outer conductor along an axial direction of the central axis; an insulator located coaxially between the outer conductor and the center terminal; and a band-shaped C-ring located inside the outer conductor. The outer conductor has a housing groove for housing the C-ring, the housing groove being formed on an inner peripheral surface of the outer conductor on a front end side of the center terminal, and the housing groove has a slope of which inner diameter is smaller on a front end side than on a rear end side, the slope being formed on a front end portion of the housing groove.

DETAILED DESCRIPTION

Figure 1:
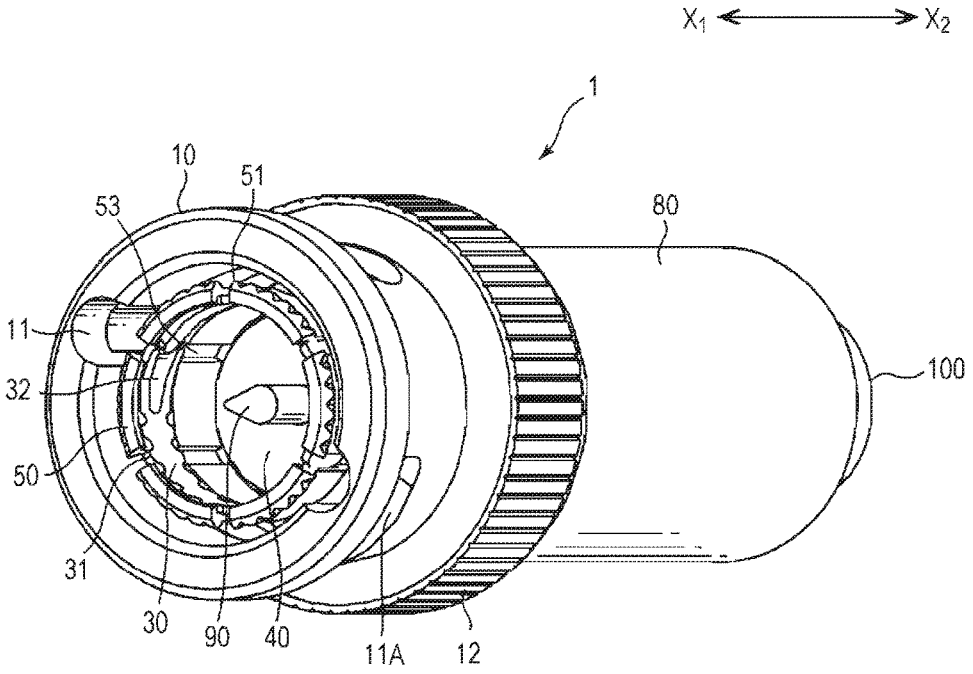
FIG. 1 is a perspective view illustrating the configuration of a BNC coaxial connector (plug) according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

An electrical connector according to the present disclosure includes: a cylindrical outer conductor; a center terminal located on a central axis of the outer conductor along an axial direction of the central axis; an insulator located coaxially between the outer conductor and the center terminal; and a band-shaped C-ring located inside the outer conductor. The outer conductor includes a housing groove for housing the C-ring, the housing groove being formed on an inner peripheral surface of the outer conductor on a front end side of the center terminal, and the housing groove includes a slope of which inner diameter is smaller on a front end side than on a rear end side, the slope being formed on a front end portion of the housing groove.

Moreover, another electrical connector according to the present disclosure includes: a cylindrical outer conductor; a center terminal located on a central axis of the outer conductor along an axial direction of the central axis; an insulator located coaxially between the outer conductor and the center terminal; and a band-shaped C-ring located inside the outer conductor. The outer conductor includes a housing groove for housing the C-ring, the housing groove being formed on an inner peripheral surface of the outer conductor on a front end side of the central terminal, and the C-ring includes a knurled outer peripheral surface.

In all the drawings for describing an embodiment, the same reference numerals are assigned to the same members in principle and their repeated descriptions are omitted.

In the following embodiment, a description is given, divided into a plurality of sections or embodiments if necessary for convenience. Unless otherwise specified, these sections are not irrelevant to each other, and are in a relationship where one is a modification, a detail, a supplementary explanation, or the like of part or whole of the other. Moreover, in the following embodiment, when the number or the like (including a piece count, a numeric value, an amount, and a range) of elements is mentioned, excluding, for example, unless otherwise specified and unless clearly limited to a specific number in theory, the number or the like of elements is not limited to the specific number and may be equal to or greater than or equal to or less than the specific number.

Figure 2:
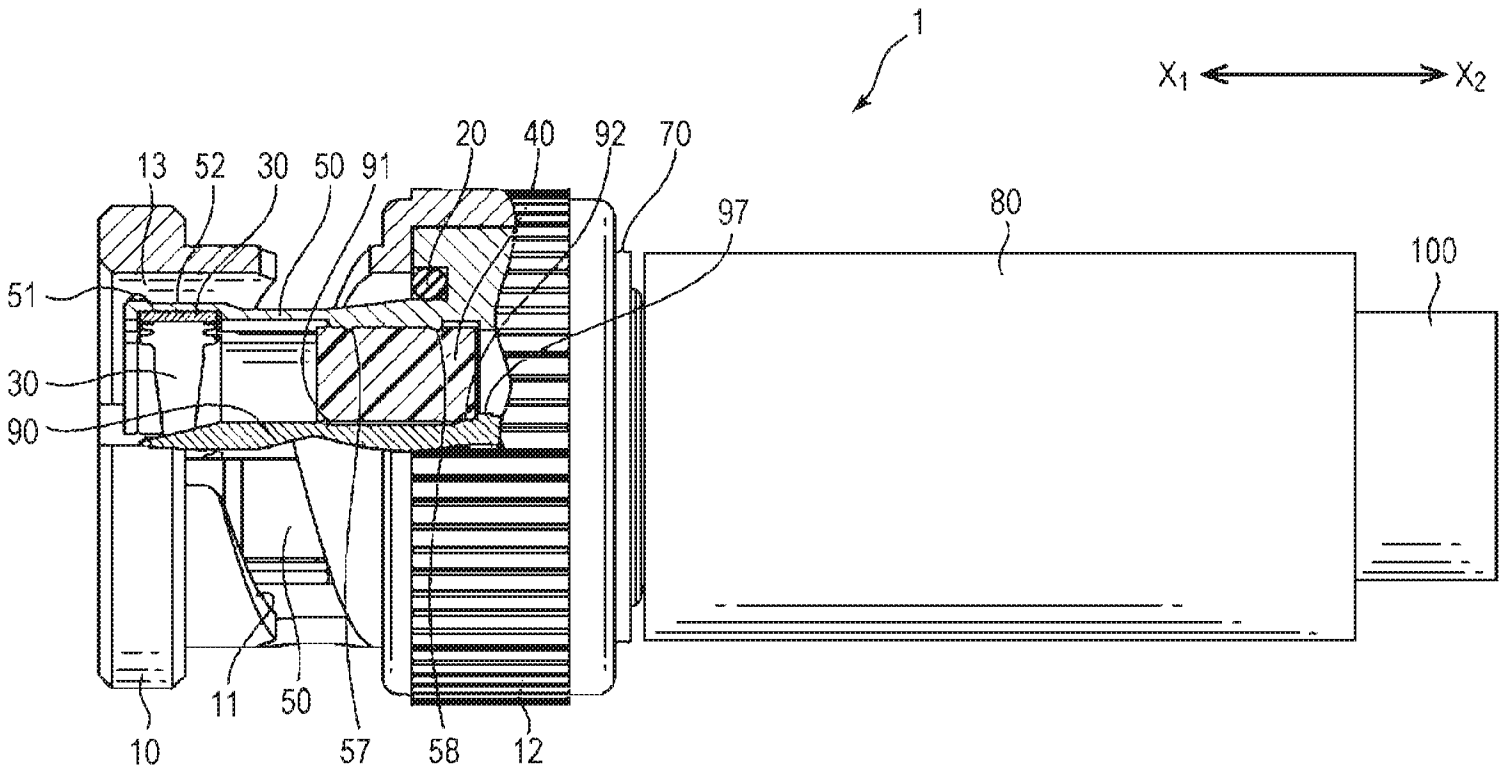
FIG. 2 is a side view including a partial cross-sectional view, illustrating the configuration of the BNC coaxial connector (plug) illustrated in FIG. 1.
Figure 3:
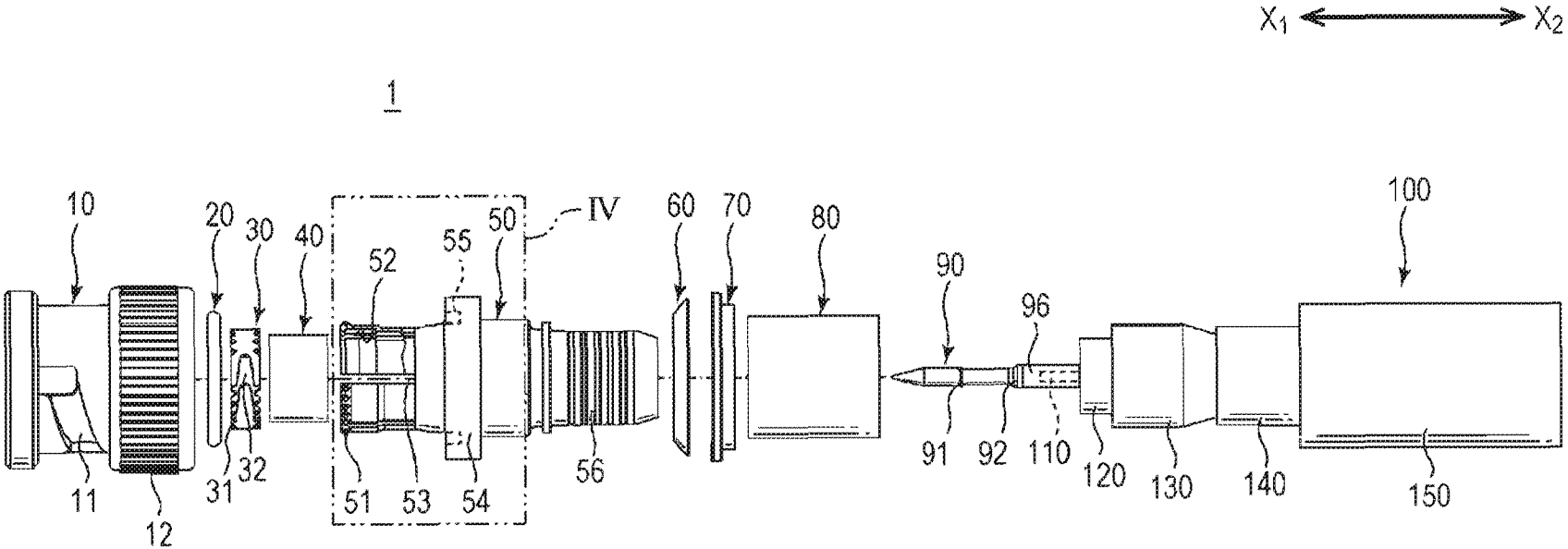
FIG. 3 is an exploded side view including a partial cross-sectional view, illustrating the configuration of the BNC coaxial connector (plug) illustrated in FIG. 1 or 2.

FIG. 1 is a perspective view illustrating the configuration of a BNC coaxial connector (plug) according to an embodiment of the present disclosure. FIG. 2 is a side view including a partial cross-sectional view, illustrating the configuration of the BNC coaxial connector (plug) illustrated in FIG. 1. FIG. 3 is an exploded side view including a partial cross-sectional view, illustrating the configuration of the BNC coaxial connector (plug) illustrated in FIG. 1 or 2.

Firstly, an example of the configuration of an electrical connector according to the embodiment is described with reference to FIGS. 1 to 3. The electrical connector according to the embodiment is a BNC coaxial connector (hereinafter simply referred to as the "plug") to which a coaxial cable is connected. This plug is fitted to a counterpart connector (hereinafter simply referred to as the "receptacle") attached to an electronic device or the like. Consequently, a cable and a signal line in the electronic device are electrically connected. As a result, the electronic device or the like is enabled to receive a signal from the outside or transmit a signal to the outside.

A plug 1 according to the embodiment is configured including a bayonet fitting portion (coupling) 10, an O-ring 20, a C-ring 30, an insulator 40, an outer conductor 50, a washer (Belleville washer) 60, a fixing ring 70, a protective sleeve 80, and a center terminal 90, which are illustrated in FIGS. 2 and 3. Moreover, a coaxial cable 100 is configured in such a manner that a dielectric 120, a (braided) shield 130, an outer sheath 140, a heat-shrink tube 150, and the like, which are illustrated in FIG. 3, are placed around a center conductor 110.

The plug 1 has a bayonet coupling mechanism. An operator performs a manual operation to push an opening end (an end portion in an X1 direction) of the plug 1 into an opening end of the receptacle along an axial direction and turn, that is, rotate the plug 1 in a clockwise direction. Consequently, the plug 1 and the receptacle are coupled. When the coupling is disconnected, the plug 1 is turned in a counterclockwise direction in this coupled state, and then removed from the opening end of the receptacle. Consequently, their coupling is disconnected. In this manner, the plug 1 and the receptacle are detachably coupled, that is, fitted to each other.

The bayonet fitting portion (coupling) 10 is a tubular member that is attached in such a manner as to be rotatable around the outer conductor 50. The bayonet fitting portion 10 is configured including a locking groove 11 provided on an inner peripheral surface of the bayonet fitting portion 10, and a rotation operating portion 12. Another locking groove 11A extending in an oblique direction of the bayonet coupling mechanism is formed in a circumferential direction of a side surface of the bayonet fitting portion 10. The rotation operating portion 12 is provided on a rear end side (an X2 direction side) of the bayonet fitting portion 10. An outer peripheral surface of the rotation operating portion 12 is knurled. The operator operates the rotation operating portion 12 to rotate the bayonet fitting portion 10. The bayonet fitting portion 10 is rotatably mounted, placed around the outer conductor 50. When the plug 1 configured in this manner and the receptacle are fitted to each other, an outer conductor of the receptacle is inserted coaxially along an X1-X2 direction into a counterpart outer conductor housing portion 13 provided between an inner side of the bayonet fitting portion 10 and an outer side of the outer conductor 50.

The O-ring 20 is a ring-shaped rubber member for dust-proofing and waterproofing, and is housed in an O-ring housing groove 55 on a side of a flange 54 of the outer conductor 50.

The C-ring 30 is a band-shaped elastic member (reinforcing spring) made of metal, for example, beryllium copper or stainless, the elastic member having an elastic force in a radial direction. The C-ring 30 is fitted into a C-ring housing groove 52 formed in an inner wall on a front end side of the outer conductor 50. A component on an inner periphery of the C-ring 30 is radially held with the elastic force to stabilize the positional relationship between the components. The C-ring 30 has a corrugated portion 31, a notch portion 32, and the like. The corrugated portion 31 is configured in such a manner that at least an end surface on a front end side thereof is corrugated as illustrated in FIGS. 1 and 3 to come into contact at a plurality of points with the outer conductor 50. A concave/convex gap is formed on a side surface of the notch portion 32. In this manner, the C-ring 30 is corrugated to partially bring the front end side of the C-ring 30 into contact at the plurality of points with the inner wall of the outer conductor 50. As a result, even if the coaxial cable is pulled and pried, at least the electrical contact between the plug 1 and the receptacle is stable, and the electrical characteristics are improved. Moreover, the notch portion 32 is formed on the C-ring 30 as described above. Hence, it is more excellent in flexibility than in a case without such a notch portion. Therefore, the contact between the plug 1 and the receptacle can be made more stable.

The insulator 40 is a cylindrical member, and is located coaxially between the outer conductor 50 and the center terminal 90. The insulator 40 is housed in the outer conductor 50. The center terminal 90 is inserted into a hole on the central axis of the insulator 40.

The outer conductor 50 is a cylindrical metal conductive member, and includes multiple protruding outer contacts (abutment portions) 51 that are configured in such a manner as to come into contact with the outer conductor of the receptacle, the C-ring housing groove 52 that houses the C-ring 30, a slot 53, the flange 54, the O-ring housing groove 55 formed on the flange 54, at a front end (the X1 direction) on an outer peripheral side surface, and a slip stopper 56 formed on a rear end side (the X2 direction) of the outer peripheral surface.

Figure 4:
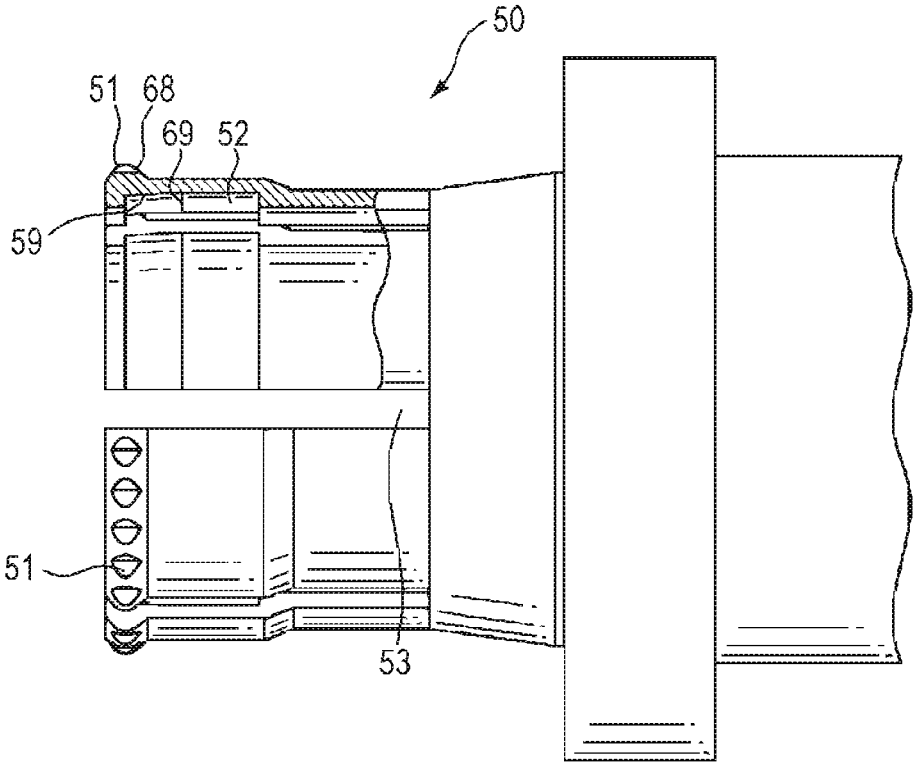
FIG. 4 is an enlarged view of the partial cross-sectional view of a fitting portion of an outer conductor illustrated in FIG. 3.

The outer contacts 51 are formed on an outer wall on the front end side (the fitting side and the X1 direction). As illustrated in FIGS. 3 and 4, the outer contacts 51 have a curved protruding shape that protrudes from the outer peripheral side surface. Upon the fitting of the receptacle being the counterpart connector, the outer conductor of the receptacle comes into contact with the outer contacts 51 to establish an electrical connection.

Moreover, a protruding front press-fitting portion 57 and rear press-fitting portion 58 for fixing the insulator 40 in the radial direction, that is, a perpendicular direction to the X1 -X2 direction are formed on a portion, which comes into contact with the insulator 40, of an inner peripheral surface of the outer conductor 50. These front press-fitting portion 57 and rear press-fitting portion 58 are formed between a front press-fitting portion 91 and a rear press-fitting portion 92 of the center terminal 90 in the axial direction (the X1-X2 direction).

The fixing ring 70 is a ring-shaped member having a step in the axial direction. Upon assembling the plug 1, an end portion of the bayonet fitting portion 10 on the right side in FIG. 2 is bent to the inner peripheral side. As a result, the bayonet fitting portion 10 is retained by the fixing ring 70 in such a manner as to be rotatable about the central axis and movable along the X1-X2 direction.

The protective sleeve 80 is a tubular member. Upon assembling the plug 1, the protective sleeve 80 is placed coaxially and press-fitted around the shield 130 of the coaxial cable 100 to fix the shield 130.

Next, the structure of the C-ring housing groove 52 of the outer conductor 50 is described in detail with reference to FIG. 4. FIG. 4 is an enlarged view of the partial cross-sectional view of the fitting portion of the outer conductor illustrated in FIG. 3. As illustrated in FIG. 4, the C-ring housing groove 52 is formed along the inner peripheral surface on the front end side (the X1 direction) of the outer conductor 50. Moreover, a slope 59 of which inner diameter is smaller on a front end side (the X1 direction) than on a rear end side (the X2 direction) is formed along an inner peripheral surface on a front end portion of the C-ring housing groove 52. In other words, the front end side (the X1 direction) of the slope 59 is inclined inward, that is, toward the center side. Moreover, a rearmost end position 69 on the rear end side (the X2 direction) of the slope 59 formed on the C-ring housing groove 52 is located on a rear end side (the X2 direction) with respect to a rearmost end position 68 on a rear end side of the outer contact 51.

In a state where the C-ring 30 is housed in the C-ring housing groove 52, an inner surface of the C-ring 30 and an inner surface of the outer conductor 50 are on substantially the same plane (that is, the radius of the inner surface of the C-ring 30 is substantially equal to the radius of the inner surface of the outer conductor 50). Moreover, the C-ring housing groove 52 may be integrally formed with the inner surface of the outer conductor 50 by pushing out the inner peripheral surface of the outer conductor 50. Moreover, in addition to the configuration of the slope 59 provided to the front end portion of the C-ring housing groove 52, a slope of which inner diameter is smaller on a rear end side (the X2 direction) than on a front end side (the X1 direction) may be also formed on a rear end portion of the C-ring housing groove 52. In this manner, the slope is formed on the C-ring housing groove 52 to bring the outer periphery of the end portion of the C-ring 30 into contact with the inner wall of the outer conductor 50. At this point in time, the contact between the C-ring 30 and the outer conductor 50 is linear contact or contact at a plurality of points. Therefore, even if the coaxial cable is pulled and pried, the contact is stable, and the electrical characteristics are improved.

Figure 5:
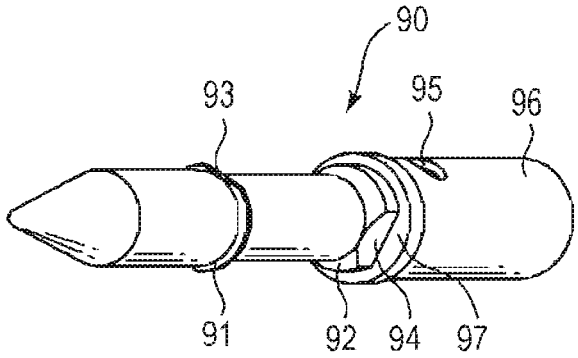
FIG. 5 is an enlarged view illustrating the configuration of a center terminal illustrated in FIG. 3.

Next, the structure of the center terminal 90 is described in detail with reference to FIG. 5. FIG. 5 is an enlarged view illustrating the configuration of the center terminal. The center terminal 90 is a needle-shaped metal member, and is located on the central axis of the outer conductor 50. The center terminal 90 includes the protruding front press-fitting portion 91 and rear press-fitting portion 92 for fixing the center terminal 90 to the insulator 40, a notch portion 93 of the front press-fitting portion, a notch portion 94 of the rear press-fitting portion, a solder hole 95, a center conductor connection portion 96, and a press-fitting stopper 97 that acts as a stopper upon press-fitting the center terminal.

The protruding front press-fitting portion 91 and rear press-fitting portion 92 are each formed on either end portion of a portion, which comes into contact with the insulator 40, of an outer peripheral surface of the center terminal 90. Moreover, the radius of the rear press-fitting portion 92 is larger than the radius of the front press-fitting portion 91. Furthermore, the front press-fitting portion 91 and the rear press-fitting portion 92 are formed outward of the front press-fitting portion 57 and the rear press-fitting portion 58 of the outer conductor 50, respectively, in the axial direction (the X1 -X2 direction). In this manner, the front press-fitting portions 57 and 91 and the rear press-fitting portions 58 and 92 are provided. Consequently, the insulator 40 hardly moves unnecessarily in both the radial direction and the axial direction, and is resistant to prying. Moreover, for example, the positions of the front press-fitting portions 57 and 91, and the positions of the rear press-fitting portions 58 and 92 can be displaced along the circumferential direction. Consequently (for example, displaced 90 degrees), the press-fitting portions on the front and rear do not interfere with each other upon press-fitting the center terminal 90, and the assembly is facilitated. Consequently, the diameter, that is, the interval between the inner diameter and the outer diameter, of the insulator 40, can be maintained constant. As a result, the value of impedance of the center terminal is stable. Hence, impedance matching can be stably conducted upon connecting to an external electronic device or the like via the receptacle. Moreover, as illustrated in FIG. 2, a little air layer can be stably provided between the outer periphery of the center terminal 90 and the inner periphery of the insulator 40 due to the existence of the front press-fitting portion 91 and the rear press-fitting portion 92. Consequently, it is possible to more stably make the diameter of the insulator 40 constant and stably conduct impedance matching with an external electronic device.

Moreover, a groove is formed in the center conductor connection portion 96 on a rear end side (the X2 direction) of the center terminal 90. The center conductor 110 of the coaxial cable 100 is inserted into the groove, and soldered using the solder hole 95. Moreover, upon the fitting of the receptacle being the counterpart connector, a center terminal of the receptacle comes into contact with the center terminal 90 to establish an electrical connection.

Figure 6:
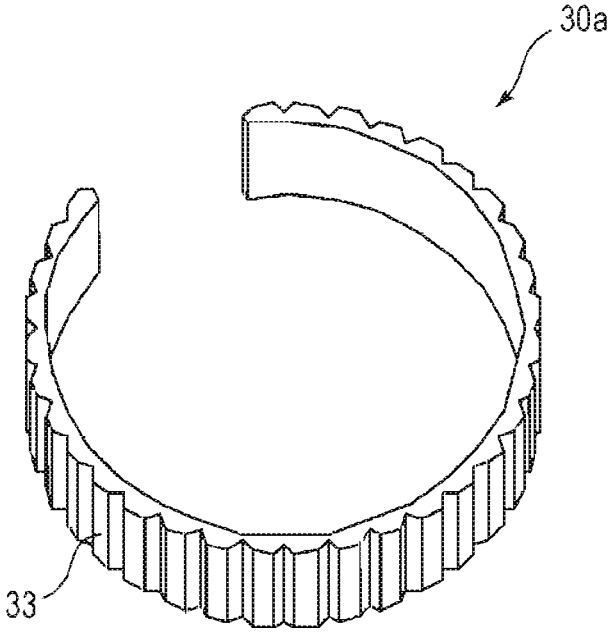
FIG. 6 is a perspective view illustrating an example of another configuration of a C-ring used in an electrical connector according to the present disclosure.

FIG. 6 is a perspective view illustrating an example of another configuration of the C-ring. In the embodiment, at least the end surface on the front end side of the C-ring 30 is corrugated. However, in FIG. 6, an outer surface of a C-ring 30*a* is rolled; accordingly, effects similar to the embodiment can exert. In other words, protrusions 33 on the knurled surface are in contact linearly or at a plurality of points with the inner wall of the outer conductor 50. Hence, even if the coaxial cable is pulled and pried, the contact is stable, and the high-frequency characteristics are improved. Moreover, the knurling pattern is simply required to be patterns having multiple indentations such as a straight and a diamond knurl. Moreover, not the entire surface but only the front end side may be knurled.

Therefore, according to the electrical connector of the embodiment, the slope of which inner diameter is smaller on the front end side than on the rear end side is formed on the front end portion of the C-ring housing groove. Accordingly, the contact is made linearly or at a plurality of points. Hence, the contact is stable and, even if prying or the like occurs, the high-frequency characteristics are improved.

Moreover, according to the electrical connector of the embodiment, the C-ring is corrugated or knurled. Hence, linear contact or contact at a plurality of points can be made. As a result, the contact is stable. Accordingly, the deterioration of the high-frequency characteristics can be prevented even if prying or the like occurs.

The effects obtained by the electrical connector according to the present disclosure are, for example, as follows:

(1) The C-ring is corrugated or knurled. Accordingly, the contact with the outer conductor is made linearly or at a plurality of points. Hence, even if prying or the like occurs, the contact is stable, and the high-frequency characteristics and other characteristics are stable.

(2) The C-ring housing groove includes the slope of which front end side is inclined inward. Accordingly, the contact with the outer conductor is linear or multiple contact. Even if prying or the like occurs, the contact is stable, and the high-frequency characteristics are improved.

(3) Due to the existence of the front and rear press-fitting portions formed on the outer conductor inner peripheral surface and the center terminal outer peripheral surface, the backlash of the insulator is reduced, and the stabilization of impedance matching can be encouraged.

The electrical connector according to the present disclosure has been specifically described above on the basis of the embodiment thereof. However, the electrical connector according to the present disclosure is not limited to the embodiment, and it is needless to say that the electrical connector according to the present disclosure can be modified in various manners within the scope that does not depart from a gist thereof.

For example, in the embodiment, the BNC coaxial connector has been described. However, the embodiment is not limited to this. The embodiment can also be applied to electrical connectors other than the BNC coaxial connector.

The electrical connector according to the present disclosure can be applied to electrical connectors for measurement, communications, video signals, and medical equipment, and may be the following first to fourteenth electrical connectors.

The first electrical connector is an electrical connector including: a cylindrical outer conductor; a center terminal located on the central axis of the outer conductor; an insulator located between the outer conductor and the center terminal; and a band-shaped C-ring located inside the outer conductor, where a housing groove for housing the C-ring is formed on a front end side of an inner peripheral surface of the outer conductor, and a slope of which inner diameter is smaller on a front end side than on a rear end side is formed on a front end portion of the housing groove.

The second electrical connector is the first electrical connector where the C-ring has a corrugated end surface on a front end side.

The third electrical connector is the first or second electrical connector where an abutment portion for coming into contact with an outer conductor of a counterpart connector is formed on a front end portion of an outer peripheral surface of the outer conductor, and the abutment portion protrudes outward.

The fourth electrical connector is the third electrical connector where the protruding shape of the abutment portion is a curved surface, and a terminal position on the rear end side of the slope formed on the housing groove is on a rear end side with respect to a terminal position on a rear end side of the abutment portion.

The fifth electrical connector is any of the first to fourth electrical connectors where an inner surface of the C-ring and an inner surface of the outer conductor are on substantially the same plane in a state where the C-ring is housed in the housing groove.

The sixth electrical connector is any of the first to fifth electrical connectors where the housing groove is formed by pushing out the inner peripheral surface of the outer conductor.

The seventh electrical connector is any of the first to sixth electrical connectors where first and second projections are formed on a portion, which comes into contact with the insulator, of an outer peripheral surface of the center terminal, and the first and second projections are formed near front and rear end portions of the insulator.

The eighth electrical connector is the seventh electrical connector where third and fourth projections are formed on a portion, which comes into contact with the insulator, of the inner peripheral surface of the outer conductor, and the third and fourth projections are formed in an axial direction between the first and second projections.

The ninth electrical connector is an electrical connector including: a cylindrical outer conductor; a center terminal located on the central axis of the outer conductor; an insulator located between the outer conductor and the center terminal; and a band-shaped C-ring located inside the outer conductor, where a housing groove for housing the C-ring is formed on a front end side of an inner peripheral surface of the outer conductor, and an outer peripheral surface of the C-ring is knurled.

The tenth electrical connector is the ninth electrical connector where an abutment portion for coming into contact with an outer conductor of a counterpart connector is formed on a front end portion of an outer peripheral surface of the outer conductor, and the abutment portion protrudes outward.

The eleventh electrical connector is the ninth or tenth electrical connector where an inner surface of the C-ring and an inner surface of the outer conductor are on substantially the same plane in a state where the C-ring is housed in the housing groove.

The twelfth electrical connector is any of the ninth to eleventh electrical connectors where the housing groove is formed by pushing out the inner peripheral surface of the outer conductor.

The thirteenth electrical connector is any of the ninth to twelfth electrical connectors where first and second projections are formed on a portion, which comes into contact with the insulator, of an outer peripheral surface of the center terminal, and the first and second projections are formed near front and rear end portions of the insulator.

The fourteenth electrical connectors is the thirteenth electrical connector where third and fourth projections are formed on a portion, which comes into contact with the insulator, of the inner peripheral surface of the outer conductor, and the third and fourth projections are formed in an axial direction between the first and second projections.

The foregoing detailed description has been presented for the purpose of illustration and description. Many modifications and variations are possible in light of the above teaching. It is not intended to be exhaust or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An electrical connector comprising:

a cylindrical outer conductor;

a center terminal located on a central axis of the outer conductor along an axial direction of the central axis;

an insulator located coaxially between the outer conductor and the center terminal; and a band-shaped C-ring located inside the outer conductor, wherein the outer conductor includes a housing groove for housing the C-ring, the housing groove being formed on an inner peripheral surface of the outer conductor on a front end side of the center terminal, and the housing groove includes a slope of which inner diameter is smaller on a front end side than on a rear end side, the slope being formed on a front end portion of the housing groove.

2. The electrical connector according to claim 1, wherein the C-ring has at least a corrugated end surface on the front end side of the center terminal.

3. The electrical connector according to claim 1, wherein the outer conductor includes an abutment portion that comes into contact with an outer conductor of a counterpart connector, the abutment portion being formed on a front end portion on an outer peripheral surface of the outer conductor, and the abutment portion protrudes outward.

4. The electrical connector according to claim 3, wherein the protruding shape of the abutment portion is a curved surface, and the slope formed on the housing groove is configured in such a manner that a rearmost end position on the rear end side is on a rear end side with respect to a rearmost end position of the abutment portion on a rear end side of the central axis.

5. The electrical connector according to claim 1, wherein the C-ring includes an inner surface that is on substantially the same plane as an inner surface of the outer conductor in a state where the C-ring is housed in the housing groove.

6. The electrical connector according to claim 1, wherein the housing groove is formed by pushing out the inner peripheral surface of the outer conductor.

7. The electrical connector according to claim 1, wherein the center terminal includes first and second projections formed on a portion, which comes into contact with the insulator, of an outer peripheral surface of the center terminal, and the first and second projections are formed near front and rear end portions of the insulator.

8. The electrical connector according to claim 7, wherein the outer conductor includes third and fourth projections formed on a portion, which comes into contact with the insulator, of the inner peripheral surface of the outer conductor, and the third and fourth projections are formed between the first and second projections in an axial direction of the center terminal.

9. An electrical connector comprising:

a cylindrical outer conductor;

a center terminal located on a central axis of the outer conductor along an axial direction of the central axis;

an insulator located coaxially between the outer conductor and the center terminal; and a band-shaped C-ring located inside the outer conductor, wherein the outer conductor includes a housing groove for housing the C-ring, the housing groove being formed on an inner peripheral surface of the outer conductor on a front end side of the center terminal, the C-ring includes a knurled outer peripheral surface, the outer conductor includes an abutment portion that comes into contact with an outer conductor of a counterpart connector, the abutment portion being formed on a front end portion on an outer peripheral surface of the outer conductor, and the abutment portion protrudes outward.

10. The electrical connector according to claim 9, wherein the C-ring includes an inner surface that is on substantially the same plane as an inner surface of the outer conductor in a state where the C-ring is housed in the housing groove.

11. The electrical connector according to claim 9, wherein the housing groove is formed by pushing out the inner peripheral surface of the outer conductor.

12. An electrical connector comprising:

a cylindrical outer conductor;

a center terminal located on a central axis of the outer conductor along an axial direction of the central axis;

an insulator located coaxially between the outer conductor and the center terminal; and a band-shaped C-ring located inside the outer conductor, wherein the outer conductor includes a housing groove for housing the C-ring, the housing groove being formed on an inner peripheral surface of the outer conductor on a front end side of the center terminal, the C-ring includes a knurled outer peripheral surface, and the center terminal includes first and second projections formed on a portion, which comes into contact with the insulator, of an outer peripheral surface of the center terminal, and the first and second projections are formed near front and rear end portions of the insulator.

13. The electrical connector according to claim 12, wherein the outer conductor includes third and fourth projections formed on a portion, which comes into contact with the insulator, of the inner peripheral surface of the outer conductor, and the third and fourth projections are formed between the first and second projections in an axial direction of the center terminal.

* * * * *